US005317324A

United States Patent [19]

Naito et al.

[11] Patent Number: 5,317,324

[45] Date of Patent: May 31, 1994

[54] PRINTED ANTENNA

[75] Inventors: Motoyuki Naito; Koichi Ito, both of Chiba, Japan

[73] Assignee: Sumitomo Metal Mining Co., Ltd., Tokyo, Japan

[21] Appl. No.: 898,507

[22] Filed: Jun. 15, 1992

[30] Foreign Application Priority Data

Jun. 20, 1991 [JP] Japan ..... 3-176212
Feb. 14, 1992 [JP] Japan ..... 4-059675
May 21, 1992 [JP] Japan ..... 4-154506

[51] Int. Cl.[5] ..... H01Q 13/08

[52] U.S. Cl. ..... 343/700 MS; 343/767; 343/770

[58] Field of Search ..... 343/700 MS, 769, 770, 343/779, 866, , 795, 767, 778, 725; H01Q 13/00, 13/08, 1/38

[56] References Cited

U.S. PATENT DOCUMENTS 4,138,684 2/1979 Kerr ..... 343/700 MS
4,692,769 9/1987 Gegan ..... 343/770
4,958,165 9/1990 Axford et al. ..... 343/770
4,987,421 1/1991 Sunahara et al. ..... 343/769
5,064,943 10/1991 Rammos ..... 343/778

FOREIGN PATENT DOCUMENTS 0355898 2/1990 European Pat. Off. .
2646967 11/1990 France .
344299 9/1991 Japan .

OTHER PUBLICATIONS

1991 IEEE article, by Naito and Ito, Published Jun. 24, 1991 Electronics Letters, Aug. 2, 1990, vol. 26, No. 16, article by Naito and Ito.
Microwave Journal, No. 4, Apr. 1987, article by Ito.

*Primary Examiner*—Donald Hajec
*Assistant Examiner*—Tan Ho
*Attorney, Agent, or Firm*—Ostrager, Chong & Flaherty

[57] ABSTRACT

In a printed antenna, a window is formed in a grounded conductor provided on one side of an insulator substrate, and a strip conductor is formed in the window as a strip antenna element. The grounded conductor has convex portions projecting toward a central portion of the strip conductor in a longitudinal direction of the strip conductor. Furthermore, in a printed antenna, a window is formed in a grounded conductor provided on one side of an insulator substrate and two strip conductor are formed in the window and a short conductor is provided to connect a longitudinally central portion of each of the strip conductor with the grounded conductor. Furthermore, in a printed antenna, a window is formed in a grounded conductor provided on one side of an insulator substrate, a strip conductor is formed in the window and a short antenna element is formed in the grounded conductor. A short conductor connects a longitudinally central portion of the strip conductor with the grounded conductor. Furthermore, a reflector plate may be provided or a plurality of the above-mentioned printed antenna are arranged on an insulator conductor.

16 Claims, 12 Drawing Sheets

PRINTED ANTENNA

BACKGROUND OF THE INVENTION

This invention relates to a printed antenna for microwave transmission and reception.

The printed antenna in which antenna elements and a transmission line are formed on a printed board has many advantages that it can be thin, light and small, it can be made in mass-production, and it can be formed integrally with electronic circuits. Such a printed antenna is used as an antenna for microwave transmission and reception of satellite broadcast, movable body communication or the like. There are various types of printed antennas. It has been increasingly noted that one type of printed antenna, in which a linear strip antenna element is used and a window is provided in a grounded conductor by cutting off the same to obtain a broad or wide band, is stable for its operation since it has only one resonance mode, compared with another type of printed antenna utilizing a patch type of element.

Furthermore, in case where a linear strip antenna element is used as an antenna for circularly polarized wave transmission and reception for use a satellite broadcasting transmission and reception, it has been proposed that the strip antenna element be combined with a slot antenna of a linear element similar to the strip antenna element, and the slot antenna element is positioned relative to the strip antenna element so that a power supplying phase difference between the strip and slot antenna elements is made 90° along the transmission line for excitation. In such a case, since the electric field radiated from the strip element and electric field radiated from the slot element are spatially perpendicular to each other, these electric fields have a phase difference of 90° in time, and at the same time, constitutes a combination of spatially crossed oscillating electromagnetic field to effectively radiate a circularly polarized wave. Although the explanation of the antenna is directed to a transmitting antenna, it should be understood that the transmitting antenna can also be used as a receiving antenna due to duality of electromagnetic field.

Such a printed antenna constructed by a combination of linear elements has a feature that it is stable for its operation as mentioned above, and in addition to that feature, it can electronically switch over between waves of right and left circular polarization, between a polarized vertical wave and a polarized horizontal wave, or between a circularly polarized wave and a linearly polarized wave for use in a satellite broadcast utilizing a satellite communication. Consequently, it has a feature that it can perform multi-functions compared with another printed antenna using a patch type of elements to be designed for transmitting and receiving a circularly polarized wave for each element.

As mentioned above, the window formed by cutting off portions of the grounded conductor can widen or expand the frequency band of the strip antenna element. At the same time, an electromagnetic wave is radiated on both sides of the antenna from the window. In order to radiate an electromagnetic wave only on one side of the antenna, a reflector plate 20 is provided as shown in FIG. 20. The reflector plate may be provided on either side of a base plate or substrate. However, in order to accomplish the purpose of reducing radiation loss from the transmission line, it is preferred that the reflector plate is provided on the side where the transmission line is positioned.

Furthermore, in order to prevent the deterioration of circularly polarized wave due to the provision of the reflector plate, the provision of a strip antenna in the window was proposed by the same inventor (Japanese Patent Application No. 344229/1989).

FIGS. 18 through 20 show a conventional printed antenna constructed by a combination of above-mentioned linear elements for radiating circularly polarized wave. Referring to these FIGS. 18 through 20, each linear strip element 10 is provided in the window 14 to effectively radiate an electromagnetic wave of frequency determined by length of linear strip antenna element by electromagnetic coupling between each linear strip element 10 and the transmission line 12. Since the window 14 is wide in its width and functions as a slot of a long length, spurious radiation is generated due to radiation from the strip antenna element 10. However, the spurious radiation can be suppressed by the provision of a pair of elements cancellation, not shown.

However, with the conventional antenna, complete cancellation of spurious radiation by use of the above-mentioned method can be made only in a certain direction and at a certain frequency. Furthermore, since gain decreases due to disturbance of radiation pattern generated by spurious radiation, a design for amending disturbance of radiation pattern at the whole arrayed antenna is required, and therefore there is a disadvantage that it is hard to design an antenna.

SUMMARY OF THE INVENTION

It is, therefore, a main object of the invention to provide a printed antenna for microwave transmission and reception in which spurious radiation from a window is reduced without the provision of cancellation elements for spurious radiation.

Another object of this invention is to provide a printed antenna for microwave transmission and reception which can reduce spurious radiation, allows good design, and has a wide frequency band and high gain.

Still another object of the invention is to provide a printed antenna for microwave transmission and reception in which spurious radiation is reduced, a band width of the property of gain-frequency of the antenna element can be made wide, and crossed polarized wave property or circularly polarized wave property is good.

In order to accomplish these objects, there is provided a printed antenna which comprises a window formed in a grounded conductor provided on one side of an insulator substrate and a strip conductor formed in the window as a strip antenna element comprising at least one convex portion of the grounded conductor projecting into the window in a direction laterally of the strip conductor.

In an aspect of one embodiment in accordance with the present invention, one strip conductor is disposed in the central position of the window and convex portions project toward the strip conductor from both sides of the window, and the convex portions are not in contact with the strip conductor.

In another aspect of embodiment in accordance with the present invention, two strip conductors are disposed in the window parallel to each other, and convex portions project toward each of the strip conductors from both sides of the window and are in contact with each strip conductor.

With still another aspect of embodiment in accordance with the present invention, one strip conductor is disposed in the central position of the window, and convex portion projects toward the strip conductor from the side where a slot antenna element is not disposed and is in contact with the strip conductor.

BRIEF DESCRIPTION OF THE DRAWINGS

The present invention will be now described in detail with reference to the preferred embodiments illustrated in the accompanying drawings in which.

DESCRIPTION OF PREFERRED EMBODIMENTS

Figure 1:
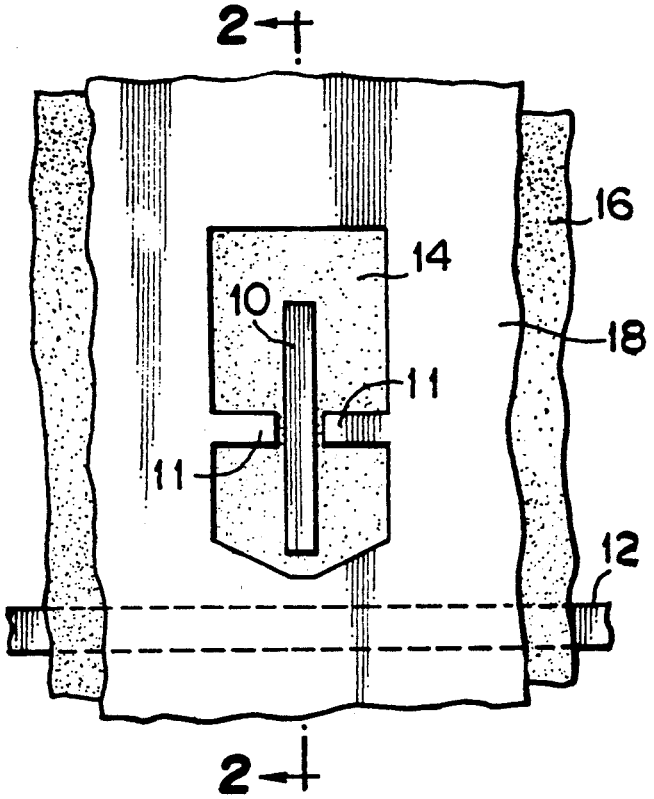
FIG. 1 is an enlarged plan view of a first embodiment of a printed antenna in accordance with the present invention.

To begin with, an explanation on the fundamental constructions of printed antennas in accordance with the present invention and the advantages obtained from the constructions will be made. With a first embodiment, convex portions are provided in the window of a grounded conductor at the central portion of a strip conductor by partially narrowing the width of the window to reduce spurious radiation from the window without narrowing a frequency band of the strip antenna element. When the distance between the opposite ends of the convex portions projecting from the grounded conductor into the window is wide, spurious radiation cannot be reduced in the same manner as in the case of no convex portions. Therefore, it is desired that the above-mentioned distance is less than three times the width of the strip antenna element.

The electric field on the strip antenna element is strongest at its ends and, therefore, at those portions the widening of the width of the window results in a wide band of the strip antenna element. The electric field is zero at the central portion of the strip antenna element, and thus even when the convex portions of the grounded conductor are disposed near the strip antenna element at the central portion thereof, the property of the strip antenna element does not change. Consequently, the leading ends of convex portions of the grounded conductor in the window may be connected to the strip antenna element. However, the wider the width of the leading ends of convex portions is, the greater the resonant frequency of the strip antenna element is. Consequently, it is desired that the width of the leading ends of convex portions is less than that of the strip antenna element.

With another embodiment, since two strip conductors or antenna elements are formed in the window, the frequency band is wide, and since the width of each strip antenna element is narrow there is only one resonance mode and the operation of the antenna element is stable. Furthermore, a short conductor for connecting the central portion of each strip conductor and the edge portions of the window can effectively suppress spurious radiation from the window.

In case where the width of the short conductor is wider than that of the strip conductor, resonant frequency of the strip conductor becomes very high, and therefore the resonant frequency cannot be determined only by the length of the strip conductor, which leads to poor designability. Furthermore, the higher the frequency is, the more the spurious radiation from the window is generated. Therefore, where the resonant frequency of the strip element becomes higher, the property of crossed polarized wave becomes worse.

With still another embodiment, a strip conductor in the window is connected by a short conductor with a grounded conductor to suppress spurious radiation from the window. At the same time, since the short conductor is provided on the side where the slot element is not disposed, the disadvantage that the radiation becomes weak due to a combination of a strip element in the window and a slot is prevented.

A reflector plate is usually disposed at a distance λ/4 from the strip conductor, where λ is a wave length of the frequency used. However, the distance is not limited to that value as far as the purpose of radiating an electromagnetic wave on either side of the antenna is accomplished. Furthermore, another insulator substrate may be sandwiched between the insulator substrate and the reflector plate to attach the reflector plate to the insulator substrate.

The insulator substrate is not limited as long as the thickness of the insulator substrate is uniform and a desired dielectric property is obtained.

Figure 2:
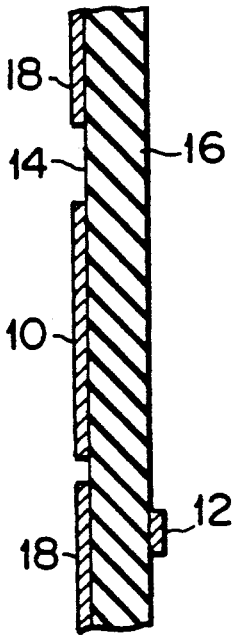
FIG. 2 is a cross-sectional view taken along line 2—2 of FIG. 1.

Now, an explanation of the embodiments in accordance with the present invention will be made specifically with reference to the drawings. Referring now to FIGS. 1 and 2, a strip antenna element 10 of 1.0 mm in width and of 7.5 mm in length is formed on one side of an insulator substrate 16 of 0.8 mm in thickness and a window 14 is formed around the strip antenna element 10 by cutting out a grounded conductor 18. In the window 14, convex portions 11 of the grounded conductors 18 which project from the opposite edges of the window toward the central portion of the strip antenna element are formed. The distance between the leading ends of the convex portions is 1.8 mm and the width of the leading end of convex portion is 0.4 mm. A transmission line 12 for excitation is formed on the other side of the insulator substrate. The end of the window is spaced at 0.8 mm distance away from the transmission line 12.

Figure 3:
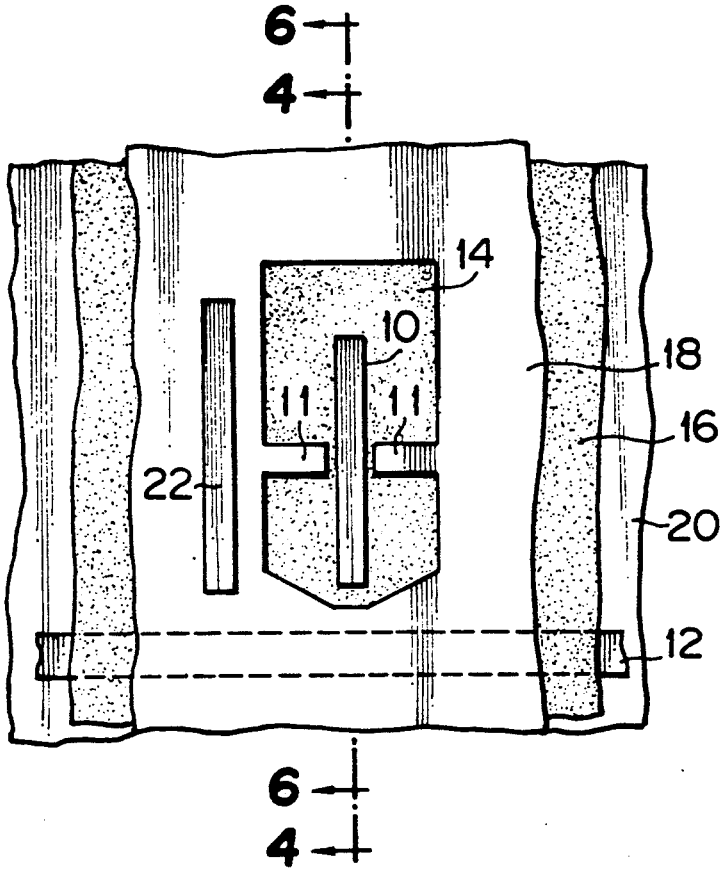
FIG. 3 is an enlarged plan view of a second embodiment in which the printed antenna of FIG. 1 is applied to a printed antenna for circularly polarized wave transmission and reception provided with a reflector plate.
Figure 4:
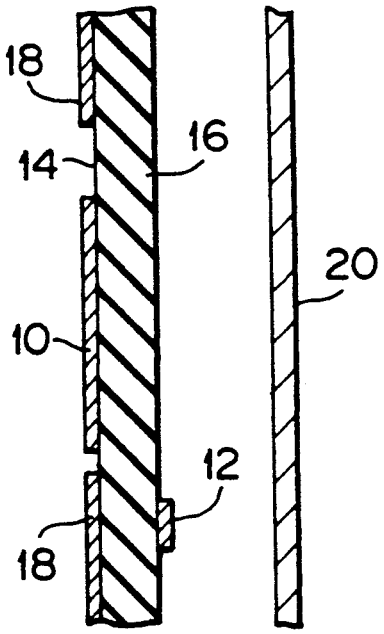
FIG. 4 is a cross-sectional view taken along line 4—4 of FIG. 3.

Referring now to FIGS. 3 and 4, there is shown a printed antenna for circularly polarized wave transmission and reception provided with a reflector plate. The printed antenna is the same as that of FIGS. 1 and 2 except that a slot antenna element 22 and a reflector plate 20 are provided.

The slot antenna element 22 is formed by removing a portion of the grounded conductor 18 so that it has a designed frequency of 12 GHz, and the slot antenna element is disposed 4.2 mm, which corresponds to ¼ wave length on the transmission line, away from the strip antenna element. The reflector plate 20 is disposed ¼ wave length from the transmission line on the other side of the insulator substrate.

Figure 5:
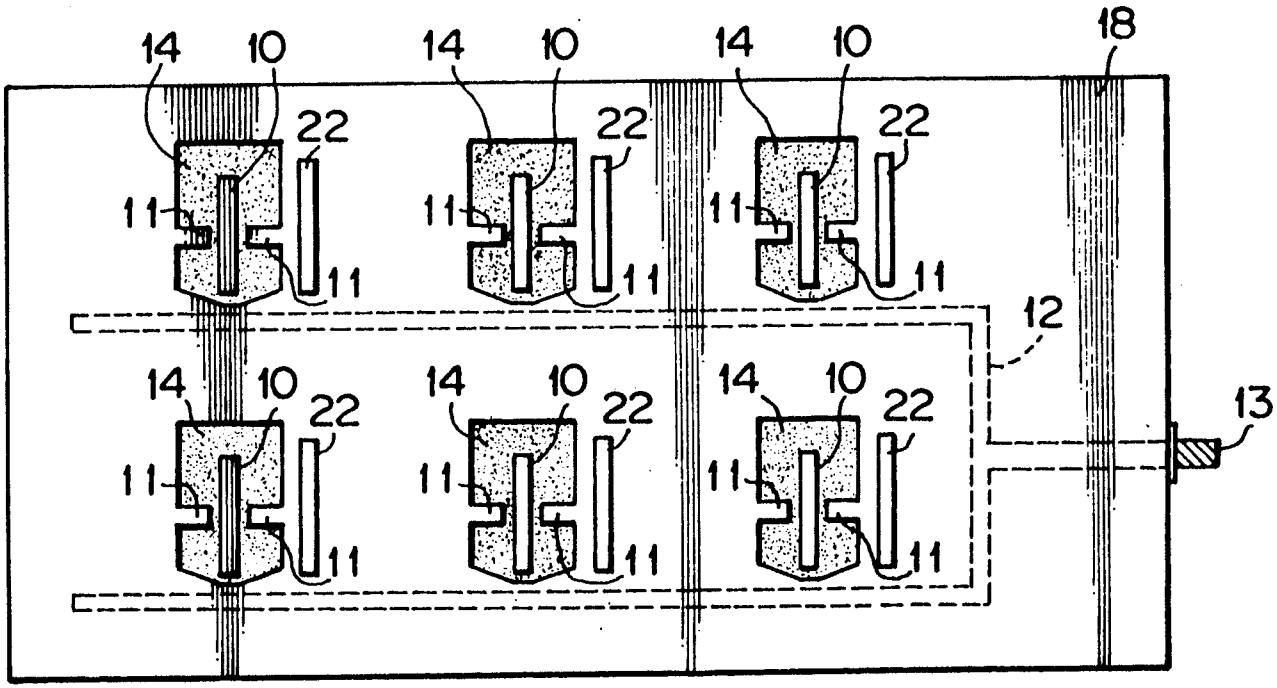
FIG. 5 is a general plan view of a third embodiment in which the printed antenna of FIG. 1 is applied to a printed antenna for circularly polarized wave transmission and reception.

FIG. 5 show an example of a printed antenna for circularly polarized wave transmission and reception which is constructed width a plurality of the printed antenna elements shown in FIGS. 3 and 4 as an integral unit. The strip antenna elements 10 and the slot antenna elements 22 are arranged in two rows along the transmission line 12 on the side thereof, with the distance between the strip antenna element and the slot antenna element being 16.8 mm, which corresponds to one wave length on the transmission line. An input and output portion 13 is disposed at the central portion between two rows of transmission line so that antenna elements in each row are excited in the same phase.

With the antenna shown in FIG. 5, the frequency at which a maximum gain is obtained is 11.9 GHz, and the axial ratio (a degree of a good circularly polarized wave) is consistent with the best frequency. When a radiation pattern in a plane perpendicular to the transmission line is measured, the maximum value of the first side lobe level is −10 dB and a difference between right and left levels is 2 dB.

Figure 18:
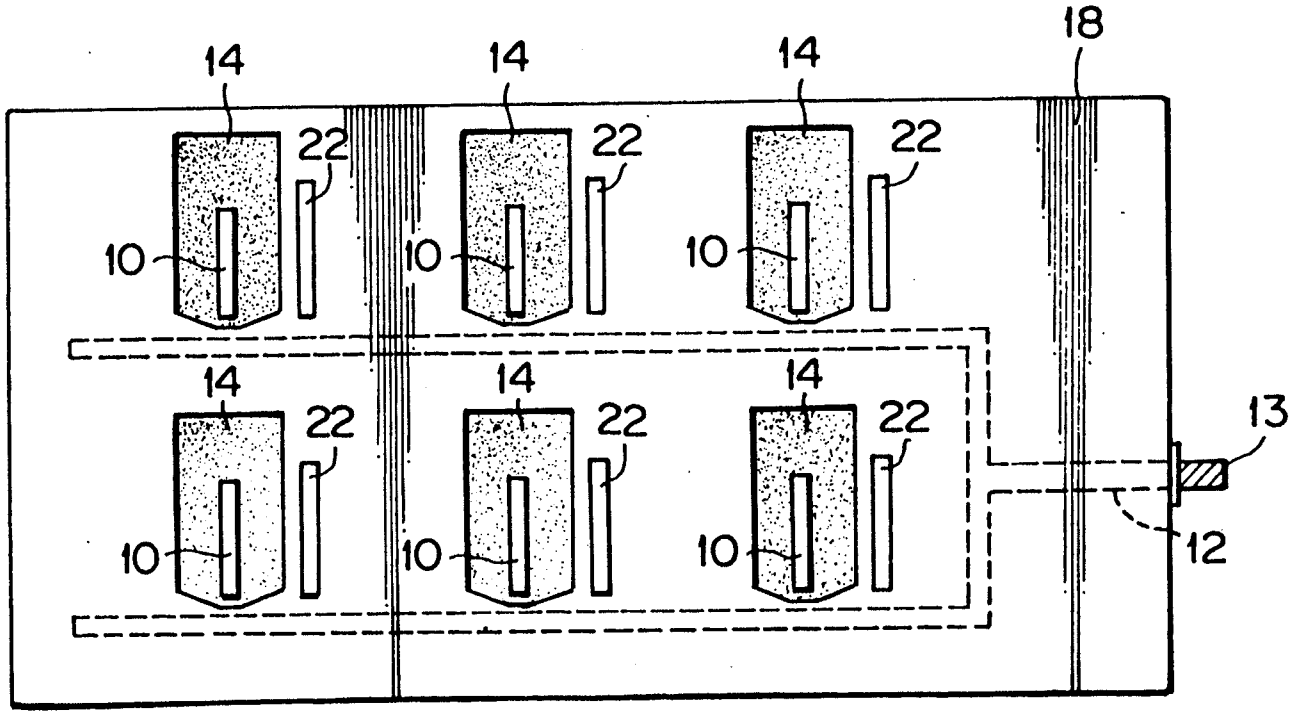
FIG. 18 (PRIOR ART)
FIG. 18 is a plan view of a conventional printed antenna made by a combination of linear elements for radiating a circularly polarized wave.

A comparison is made to the conventional printed antenna of FIG. 18, in which convex portions are not provided and the lengths and positions of the strip antenna elements and the slot antenna elements are adjusted to obtain a maximum gain. The maximum gain is obtained at a frequency of 11.6 GHz and a frequency at which axial ratio is the best is 11.9 GHz. At that time, the end of the window is spaced 0.2 mm away from the transmission line for excitation. Similarly, when a radiation pattern is measured, the maximum value of the first side lobe level is −5 dB and a difference between right and left levels is 10 dB.

Figure 6:
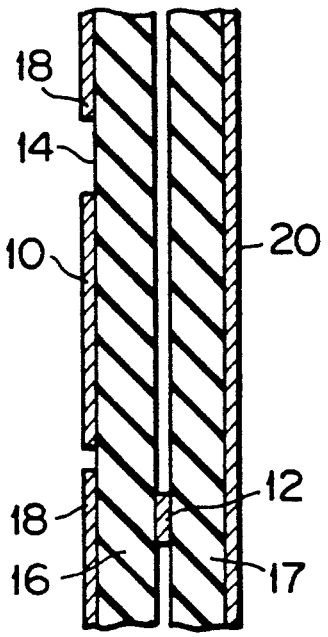
FIG. 6 is a cross-sectional view taken along the line 6—6 of FIG. 3 showing a fourth embodiment in which an insulator substrate is sandwiched between a reflector plate and an antenna.

Referring now to FIG. 6, there is shown another printed antenna for circularly polarized wave transmission and reception in which another insulator substrate is sandwiched between a reflector plate and an antenna. With the antenna, a strip antenna element 10 of 1.2 mm in length in width and of 9.25 mm is formed on one side of an insulator substrate 16 of 2.0 mm in thickness, and a window 14 is formed around the strip antenna by cutting out a grounded conductor 18. In the window 14, convex portions 11 of the grounded conductor 18 which project from the opposite edges of the window toward the central portion of the strip antenna element are formed. The distance between the leading ends of the convex portions is 0.4 mm. A slot antenna element 22 of 1.0 mm in width and of 8.1 mm in length is formed by removing a portion of the grounded conductor 18. A reflector plate 20 is attached to the antenna by an insulator substrate 17 having the same property and thickness as those of the insulator substrate 16. Furthermore, the end of the window is spaced 0.6 mm away from the transmission line 12 for excitation and the end of the strip antenna element is spaced 1.4 mm away from the transmission line 12 for excitation.

Figure 7:
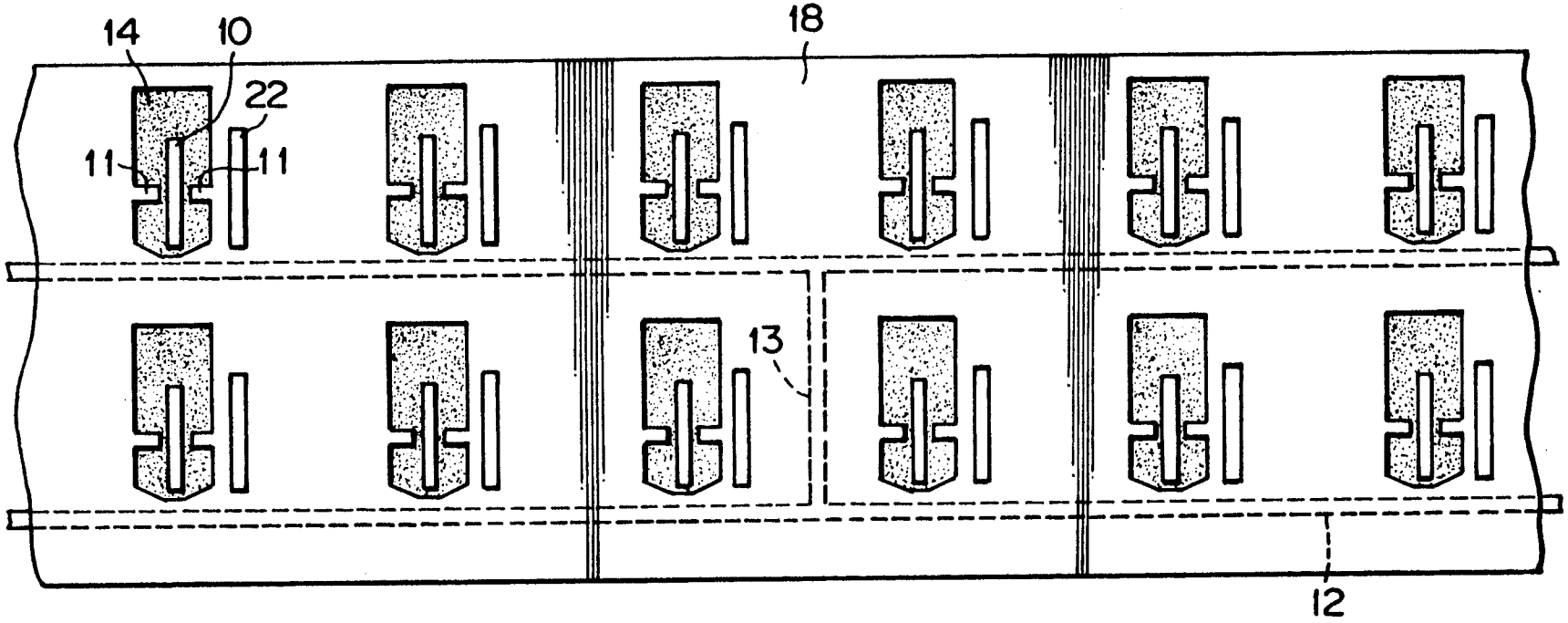
FIG. 7 is a general plan view of the fourth embodiment.

As shown in FIG. 7, a printed antenna for circularly polarized wave transmission and reception is constructed width a plurality of the printed antenna elements as an integral unit as shown in FIG. 6. With the antenna shown in FIG. 7, strip antenna elements 10 and slot antenna elements 22 are disposed on the side of transmission line 12 with the distance between these elements 10 and 22 being 20.6 mm, which corresponds to one wave length on the transmission line, and an input and output portion 13 is disposed at the central portion between rows of transmission line so that antenna elements in each row are excited in the same phase.

When the circularly polarized wave property of the antenna shown in FIG. 7 is measured, the frequency at which the maximum gain is obtained is 11.9 GHz and the axial ratio, or the degree of good circularly polarized wave, is 12.0 GHz. Furthermore, when a radiation pattern in a plane parallel to the transmission line is measured, the maximum value of the first side lobe level is −10 dB and a difference between right and left levels is 4 dB. The radiation pattern approximately exhibits a form of sin (x)/x.

Figure 19:
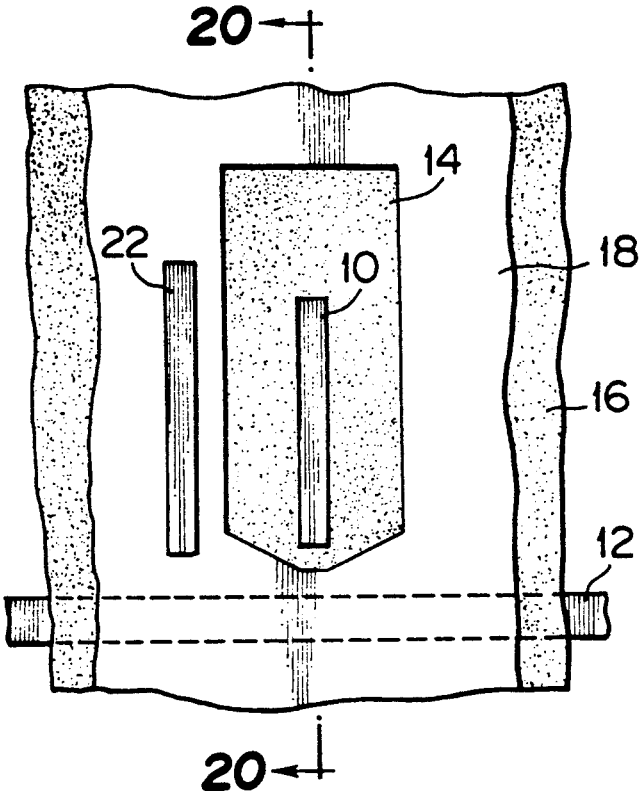
FIG. 19 (PRIOR ART)
FIG. 19 is a plan view showing a pair comprising a conventional strip antenna element provided with a window and a slot antenna element constituting the printed antenna of FIG. 18.
Figure 20:
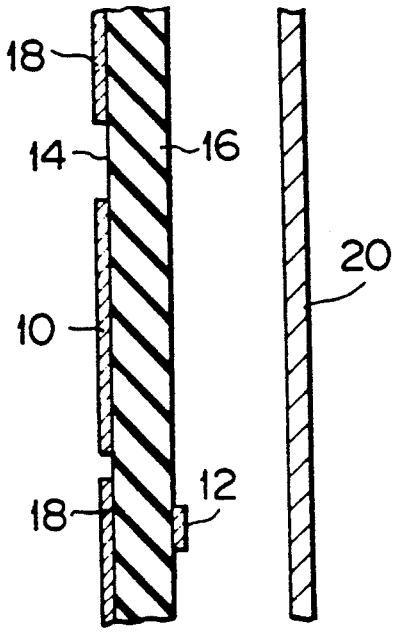
FIG. 20 (PRIOR ART)
FIG. 20 is a cross-sectional view taken along the line 20—20 of FIG. 19.

A comparison is made to, the antenna, in which the same fundamental elements as those of the conventional printed antenna in the window as shown in FIG. 19, and the other portions are constructed to be the same as those of FIG. 7 with the lengths and positions of the strip antenna elements and the slot antenna elements being adjusted to obtain a maximum gain. When the circularly polarized wave property of the antenna is measured, the frequency at which the maximum gain is obtained is 11.8 GHz. Similarly, when the radiation pattern in a plane parallel to the transmission line is measured, a maximum value of the first side lobe level is −6 dB, and a difference between right and left levels is 0 dB. However, there are spurious radiations in high level of −13 dB on both sides of the antenna in a direction of 45° from the front surface of the antenna, and thus the radiation pattern is quite different from the form of sin (x)/x.

Therefore, it is found that in the construction of the antenna in accordance with the present invention, the frequency at which the maximum gain is obtained is consistent with the frequency at which the axial ratio is good, and the disturbance of radiation pattern due to the spurious radiation from the window can be suppressed. That is, with the antenna provided with convex portions in the window, the disturbance of radiation pattern due to spurious radiation is improved. At the same time, since the end of the window can be positioned away from the transmission line (in the example, the distance is 0.8 mm), it is found that the frequency at which the maximum gain and the frequency at which the axial ratio is good are consistent to each other without variation of the property of transmission line, and designability is improved.

Figure 8:
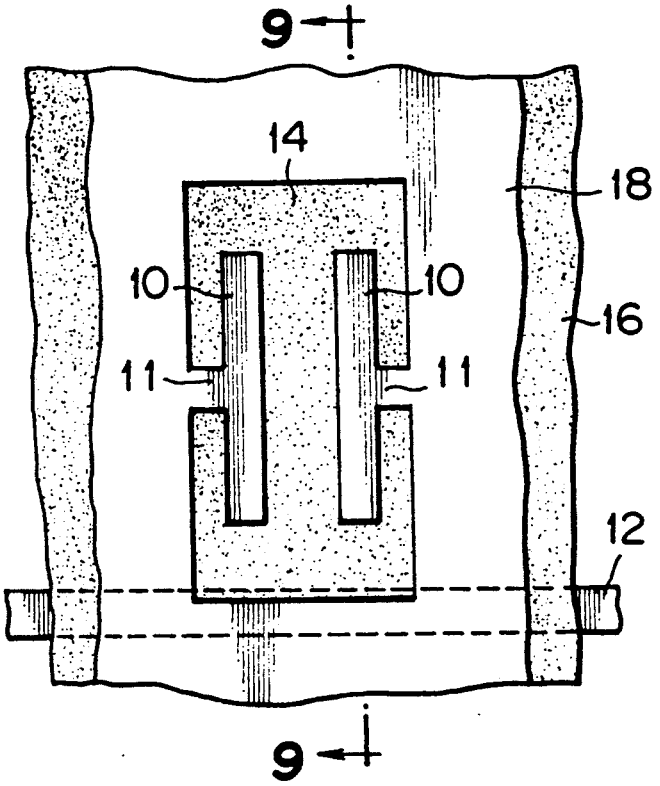
FIG. 8 is an enlarged plan view of a fifth embodiment of a printed antenna in accordance with the present invention.
Figure 9:
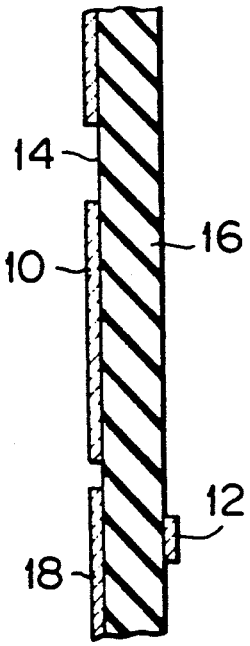
FIG. 9 is a cross-sectional view taken along the line 9—9 of FIG. 8.

Now, still another embodiment in which an improvement is introduced in the first embodiment will be explained. Referring to FIGS. 8 and 9, an antenna element comprising two strip conductors each of 1.0 mm in width and of 9.2 mm in length is formed on one side of an insulator substrate 16 of 2.0 mm in thickness in a rectangular window 14 of 9.2 mm in length and of 5.5 mm in width. With that antenna, the distance between the two strip conductors is 1.5 mm, the central portion of each strip conductor is connected to each edge of the window by short conductors, and a transmission line 12 is formed on the other side of the insulator substrate 16.

Figure 10:
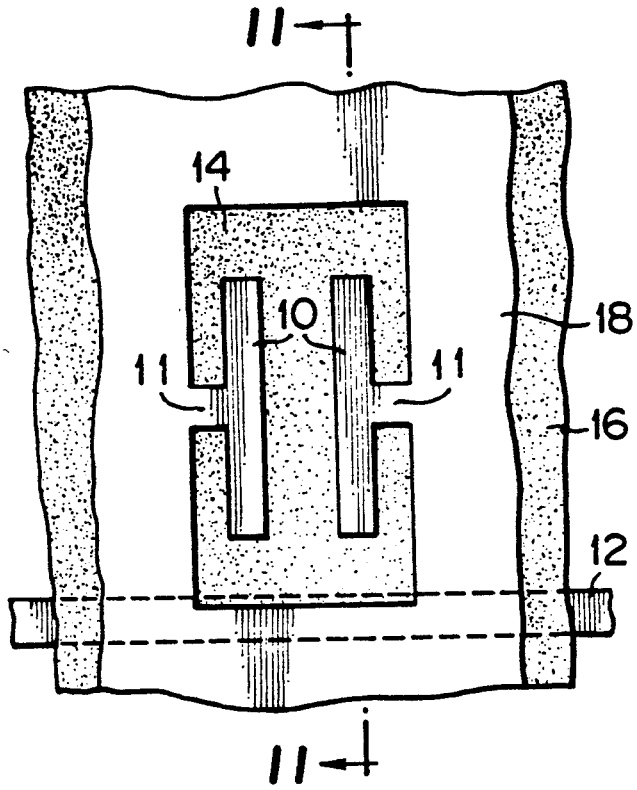
FIG. 10 is an enlarged plan view of a sixth embodiment in which the printed antenna of FIG. 8 is applied to a printed antenna for linearly polarized wave transmission and reception provided with a reflector plate.
Figure 11:
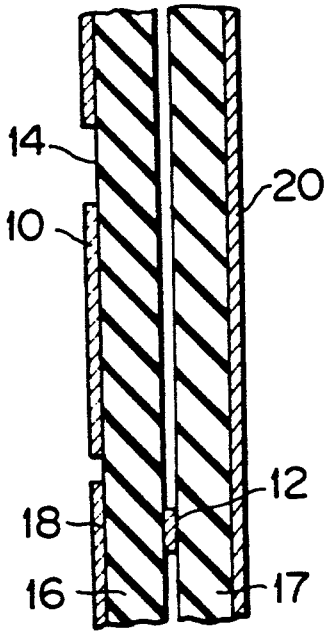
FIG. 11 is a cross-sectional view taken along the line 11—11 of FIG. 10.

Referring now to FIGS. 10 and 11, there is shown a printed antenna for linearly polarized wave transmission and reception provided with a reflector plate which is derived from the antenna of FIGS. 8 and 9. The antenna is the same as that of FIGS. 8 and 9 except that a reflector plate 20 is disposed on the transmission line side of the substrate through another insulator substrate 17 of 2.0 mm in thickness.

In front of the antenna of FIGS. 10 and 11, the lengths of strip antenna elements are adjusted to 9.4 mm so that a radiation power strength of a main polarized wave is highest. As a result, the frequency band at the half value of radiation power of main polarized wave is 450 MHz, and suppression ratio of crossed polarized wave is −15 dB. Furthermore, the antenna is constructed in a similar manner to that of FIGS. 10 and 11 except for the configuration of the window and the lengths of strip elements.

Thus, it is found that in the construction according to the present invention, even when the window is not tapered the property of crossed polarized wave is the same as that of the conventional antenna comprising a strip antenna element in the tapered window, and at the same time a wide band of frequency can be obtained.

Figure 12:
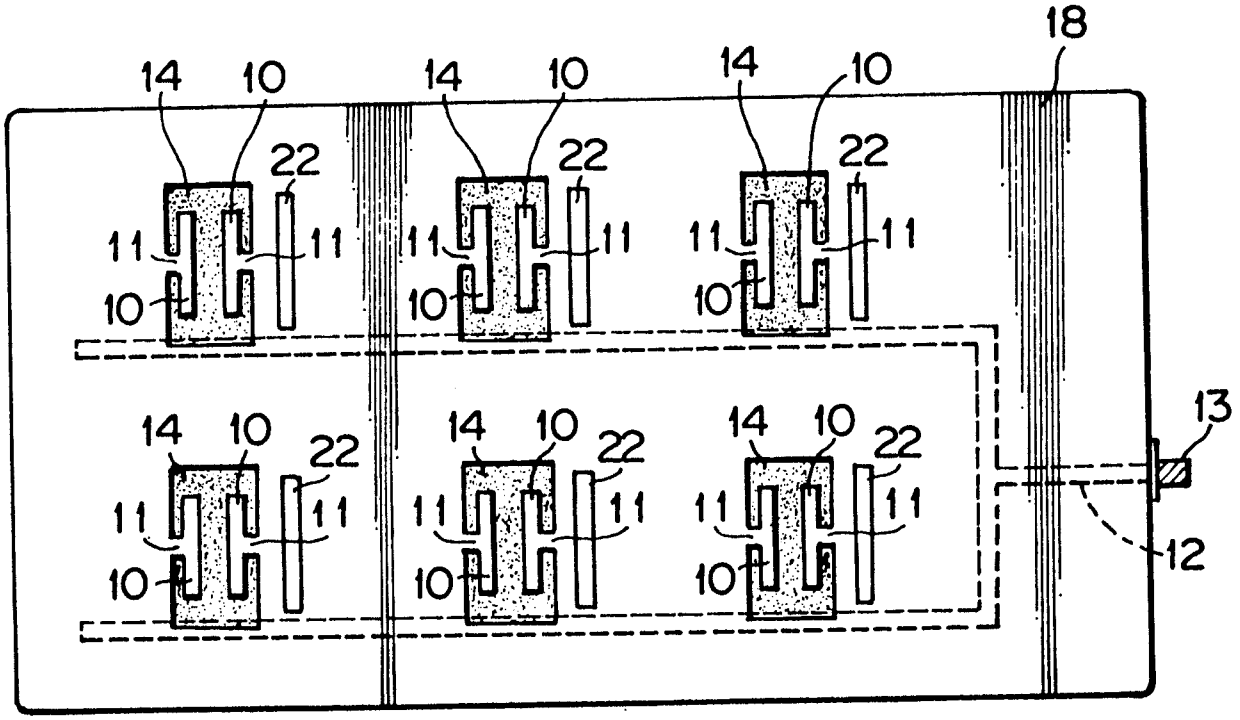
FIG. 12 is a general plan view of a seventh embodiment in which the printed antenna is applied to a printed antenna for circularly polarized wave transmission and reception.

In FIG. 12, there is shown an example of a printed antenna for circularly polarized wave transmission and reception which is constructed by a printed antenna made with the provision of a slot antenna element 22 to the printed antenna as a unit.

With the slot antenna element, a percent band width of frequency at the half value of radiation power of main polarized wave is in general 10%. Since with the antenna of FIGS. 10 and 11, its band width of frequency is 80 MHz, and a percent band width of frequency is 7%, it is easily understood that with the printed antenna shown in FIG. 12, the property of circularly polarized wave is good.

Figure 13:
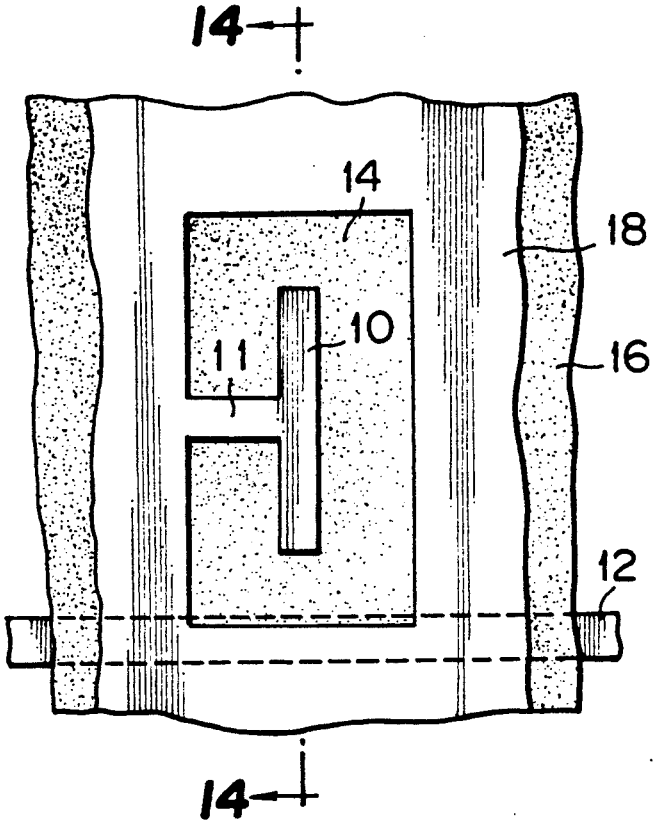
FIG. 13 is an enlarged plan view of an eighth embodiment of a printed antenna in accordance with the present invention.
Figure 14:
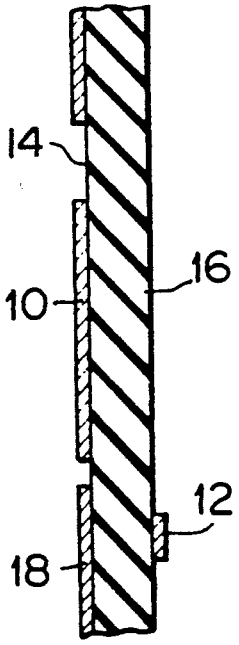
FIG. 14 is a cross-sectional plan view taken along the line 14—14 of FIG. 13.

Now, still another embodiment in which an improvement is introduced in the first embodiment from another aspect will be explained. Referring to FIGS. 13 and 14, an antenna element 10 of 1.0 mm in width and of 9.2 mm in length is formed on one side of an insulator substrate 16 of 2.0 mm in thickness in a rectangular window 14 of 14 mm in length and of 5.5 mm width. At that time, the central portion of the strip conductor is connected to the edge portion of the window by a short conductor of 0.4 mm in width.

Figure 15:
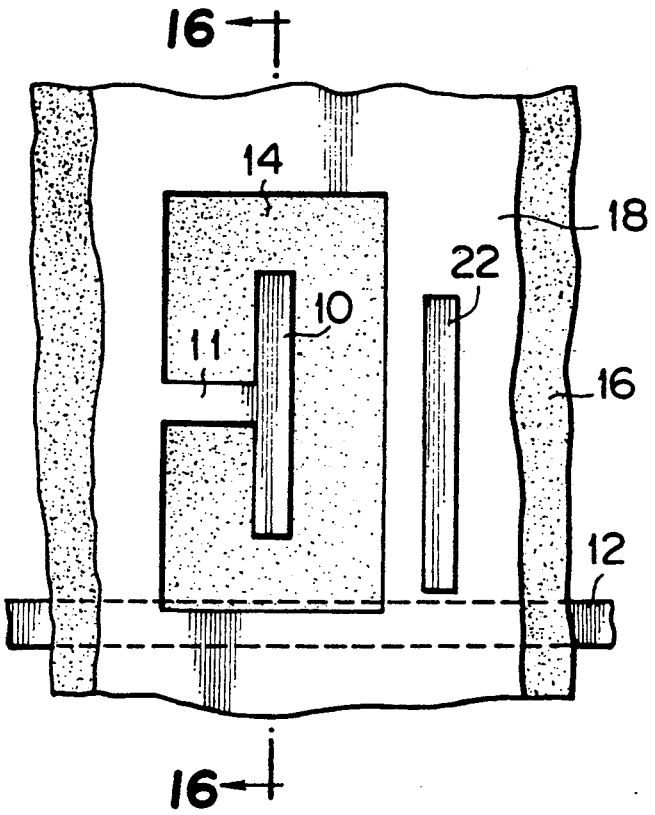
FIG. 15 is an enlarged plan view of a ninth embodiment in which the printed antenna is applied to a printed antenna for circularly polarized wave transmission and reception provided with a reflector plate.
Figure 16:
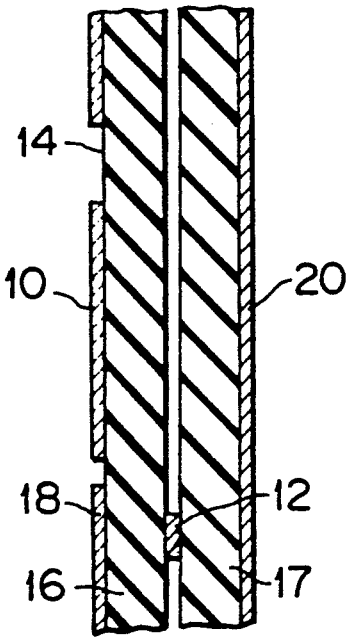
FIG. 16 is a cross-sectional view taken along the line 16—16 of FIG. 15.

Referring now to FIGS. 15 and 16, there is shown a printed antenna for circularly polarized wave transmission and reception provided with a reflector plate which is derived from the printed antenna of FIGS. 13 and 14. With the antenna, a slot antenna element 22 is formed spaced from the edge of the window opposite to the short conductor 11 and a reflector plate 20 is provided through another insulator substrate 17 of 2.0 mm in thickness on the transmission line side of the insulator substrate 16.

In front of the printed antenna shown in FIGS. 15 and 16, a good circularly polarized wave is obtained without strong connection between the slot antenna element and the strip antenna element, and radiation power strength is highest at the frequency of 11.8 GHz. On that condition, when a printed antenna for linearly polarized wave transmission and reception comprising a strip antenna element provided with a reflector plate by covering the slot antenna element 22 with a conductor is prepared, crossed polarized wave suppression ratio (ratio of a radiation electric field strength of a crossed polarized wave to a main polarized wave) is of a good value of −25 dB.

A comparison is made to the construction of the printed antenna of FIGS. 4 and 6. The length of the strip conductor 10 is adjusted to be 9.4 mm so that the radiation power strength of the main polarized wave is highest at a frequency of 11.8 GHz, and the crossed polarized wave suppression ratio is −15 dB. Furthermore, the antenna for comparison is the same as the antenna in which the slot antenna in the antenna as shown in FIGS. 15 and 16 is covered with the conductor except for the configuration of the window and the length of the strip element.

Thus, it is found that in the construction of the present invention, the property of crossed polarized wave is good without the provisions of taper on the window, and a good circularly polarized wave is obtained by a combination of a slot antenna element and a strip antenna element.

Figure 17:
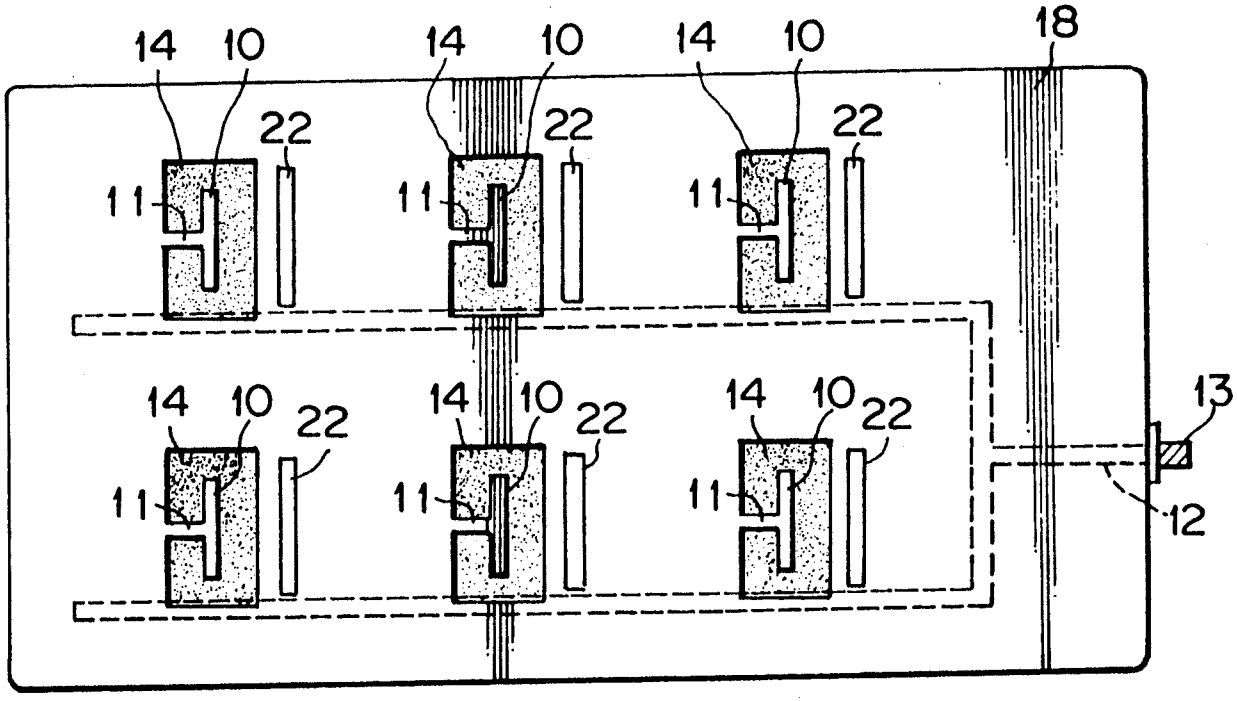
FIG. 17 is a general plan view of a tenth embodiment in which the printed antenna of FIG. 1 is applied to a printed antenna for circularly polarized wave transmission and reception.

FIG. 17 shows an example of a printed antenna for circularly polarized wave transmission and reception constructed by a plurality of the printed antenna elements of FIGS. 15 and 16 as an integral unit.

When, with the antenna shown in FIG. 17, a gap between arrangements of fundamental elements is of one length wave of a transmission line 12, radiation strength is highest in front of the antenna, and at the same time a circularly polarized wave is good. It is found from those that a connection between the slot antenna element and the transmission line is not strong enough to disturb the property of the transmission line, and its designability is good.

What we claim is:

1. A printed antenna which comprises a window opening formed in a grounded conductor layer provided on a front side of an insulator substrate, and a strip conductor arranged in the window opening of the grounded conductor layer as a strip antenna element which has a width in a horizontal direction and a length in a vertical direction of said grounded conductor layer, said grounded conductor layer being further formed with convex portions in the form of short segments having leading ends thereof projecting into said window opening closely spaced a short distance apart from a central portion of the length of said strip conductor from respective sides of said window opening formed in said grounded conductor layer and aligned in the horizontal direction of said grounded conductor layer relative to said strip conductor.

2. A printed antenna according to claim 1 in which said convex portions are disposed symmetrical with respect to an axis along the length of said strip conductor, and a distance between leading ends of said convex portions is more than the width of said strip conductor and is less than three times of the width of said strip conductor.

3. A printed antenna according to claim 1 in which the width of leading end of each convex portion is less than the width of said strip conductor.

4. A printed antenna according to claim 1 in which a slot antenna element is formed as a slot cut in said grounded conductor layer adjacent to said window opening with said strip conductor.

5. A printed antenna constructed with a plurality of printed antenna units each having the aforementioned structure described in claim 1 provided on said insulator substrate.

6. A printed antenna according to claim 1 in which a reflector plate is provided on a rear side of said insulator substrate spaced by at least a thickness of said insulator substrate from said grounded conductor layer.

7. A printed antenna which comprises a window opening formed in a grounded conductor layer provided on a front side of an insulator substrate, two strip conductors arranged in the window opening of the grounded conductor layer spaced apart in parallel from each other, each of which has a width in a horizontal direction and a length in a vertical direction of said grounded conductor layer, and a short conductor extending in the horizontal direction and connecting a central portion of the length of each of said strip conductors with a respective side of said window opening formed in said grounded conductor layer.

8. A printed antenna according to claim 7 in which the width of said short conductor is less than the width of said strip conductor.

9. A printed antenna according to said grounded conductor layer adjacent to said window opening with said strip conductor.

10. A printed antenna constructed with a plurality of printed antenna units each having the aforementioned structure described in claim 7 provided on said insulator substrate.

11. A printed antenna according to claim 7 in which a reflector plate is provided on a rear side of said insulator substrate.

12. A printed antenna which comprises a window opening formed in a grounded conductor layer provided on a front side of an insulator substrate, a strip conductor arranged in the window opening of the grounded conductor layer which has a width in a horizontal direction and a length in a vertical direction of said grounded conductor layer, a slot antenna element formed as a slot cut in the grounded conductor layer on one side adjacent to and spaced a short distance apart from said window opening with said strip conductor, and said grounded conductor layer being further formed with a short conductor extending in the horizontal direction and connecting a central portion of the length of said strip conductor with a side of said window opening formed in said grounded conductor layer.

13. A printed antenna according to claim 12 in which said short conductor is connected between said strip conductor and said grounded conductor layer on an opposite side of said window opening from said slot antenna element.

14. A printed antenna according to claim 12 in which the width of said short conductor is less than the width of said strip conductor.

15. A printed antenna constructed with a plurality of printed antenna units each having the aforementioned structure described in claim 12 provided on said insulator substrate.

16. A printed antenna according to claim 12 in which a reflector plate is provided on a rear side of said insulator substrate spaced by at least a thickness of said insulator substrate from said grounded conductor layer.

* * * * *